United States Patent [19]

Reimann

[11] 4,215,388

[45] Jul. 29, 1980

[54] NOVELTY BUTTON

[76] Inventor: Roman M. Reimann, 2717 Titus Ave., Rochester, N.Y. 14622

[21] Appl. No.: 959,347

[22] Filed: Nov. 9, 1978

[51] Int. Cl.[2] ..... F21L 15/08

[52] U.S. Cl. ..... 362/104; 362/800; 362/191

[58] Field of Search ..... 362/104, 103, 191, 800

[56] References Cited

U.S. PATENT DOCUMENTS 3,866,035 2/1975 Richey ..... 362/104

*Primary Examiner*—Stephen J. Lechert, Jr.

*Attorney, Agent, or Firm*—Fred L. Denson

[57] ABSTRACT

A novelty button is provided with electronic circuitry comprising an oscillator, a switch and a battery connected to the input terminals of the oscillator and two (2) light-emitting diodes connected to the output terminals of the oscillator. The circuitry is enclosed within a housing having apertures therein through which the light-emitting diodes and the switch extend. The two (2) light-emitting diodes form the eyes of a facial design provided on the housing which when activated by the circuitry appear to repeatively wink or blink.

3 Claims, 4 Drawing Figures

FIG. 1
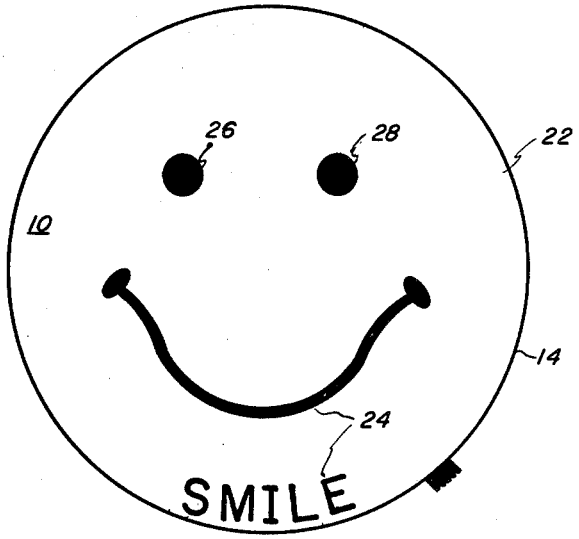
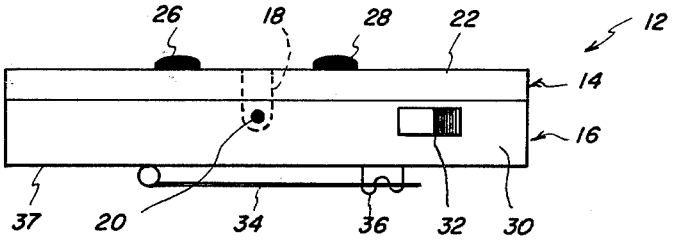
FIG. 2

NOVELTY BUTTON

BACKGROUND OF THE INVENTION

The invention relates to a novelty button and, more particularly, to an improved novelty button having circuitry which simulates winking or blinking eyes by the periodic emission of brief flashes of light.

The rapid growth or solid state electronics has spurred the development of many new consumer items. One object of the invention is to provide as a new consumer item a novelty button having solid state components which provide periodic pulses or flashes of light that appear on a button face as winking or blinking eyes. Another object of the invention is to provide such an improved novelty button which can be constructed with inexpensive components that are simple to assemble and yet provide dependable and long life operation.

These and other objects are accomplished in accordance with the present invention by providing a novelty button having circuitry including an oscillator, a microswitch and a dry cell battery connected to the input terminals of the oscillator and at least one (1) light-emitting diode connected to the output terminals of the oscillator. The circuitry is enclosed within a housing having at least two (2) apertures therein through which the light emitting diode and the switch extend. In a preferred embodiment of the invention, two (2) light-emitting diodes form the eyes of a facial design provided on one (1) surface of the housing. When the circuit is activated, the oscillator provides high pulses of current and sufficient voltage is generated to the diodes which in turn causes the diodes to periodically flash on and off.

The novelty button of the present invention can be mounted on clothing, plastic or paper by suitable fastening mechanisms such as a pin and utilized as a conversation item. Alternatively, the novelty button can, with proper selection of battery size, be used as a paper weight or provided with a magnet for attachment to refrigerators, car dashes, etc., and used as a night light indicator.

The invention, its operation and its objects and advantages will become more apparent by referring to the accompanying drawings wherein corresponding parts are identified by like numerals and to the ensuing detailed description of the preferred embodiment.

BRIEF DESCRIPTION OF THE DRAWINGS

Referring to the drawings:

FIG. 1 is a plan view of a novelty button constructed in accordance with a preferred embodiment of the invention;

FIG. 2 is a side elevational view of the button housing illustrated in FIG. 1;

DETAILED DESCRIPTION OF THE PREFERRED EMBODIMENT

Figure 3:
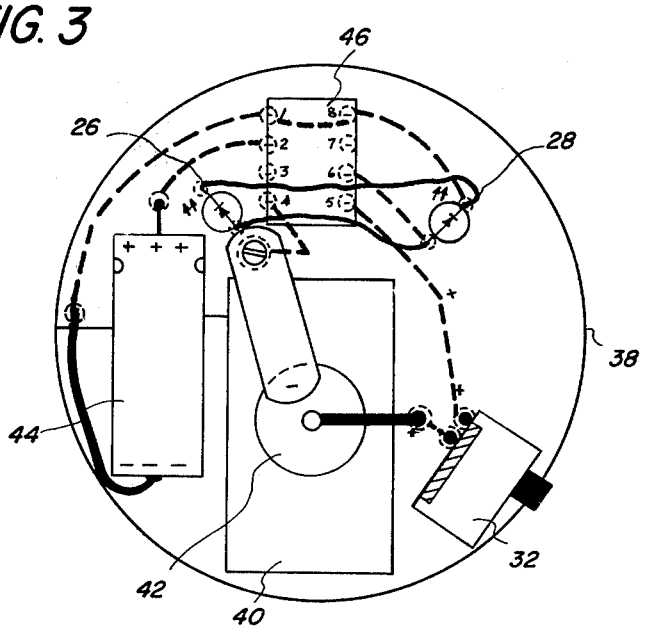
FIG. 3 is a plan view of a printed circuit board enclosed within the button housing and showing the mounting arrangement of the electrical components of the circuit; and, FIG. 4 is a schematic diagram of the electrical components shown in FIG. 3.

Referring now to the drawings and in particular to FIG. 1 and 2, there is shown the housing 12 of a novelty button designated by the reference numberal 10. The housing 12 is made of a suitable material such as plastic or metal, and is formed in the shape of a cylinder comprising an upper portion 14 and a lower portion 16. The upper and lower portions 14 and 16 are hinged together by means (not shown) and held together in the closed position shown in the drawings by means of a latch 18 and a pin 20.

The external, upper surface 22 of housing portion 14 has indicia 24 thereon which in the illustrated embodiment are a grinning mouth and the word "SMILE". The surface 22 also has two (2) apertures therein through which two (2) light-emitting diodes (LED) 26 and 28, respectively extend. The LEDs 26 and 28 form part of the button's electronic circuitry which will be described in detail below with reference to FIGS. 3 and 4. In other embodiments which are contemplated to be within the scope of the invention, different indicia and/or a different number of LEDs may be arranged on the surface 22.

A side wall 30 of the lower housing portion 16 has an aperture formed therein through which a switch 32 extends. A pin 34 and a clasp 36 mounted on the external lower surface 37 of housing portion 16 in combination form a means to fasten the button 10 to a person's clothing. It is to be understood, however, that other fastening mechanisms can be used, for example a magnet for attaching the button to metal objects, or that the fastening mechanism may be eliminated if the button 10 is to be used as a paperweight.

Figure 4:
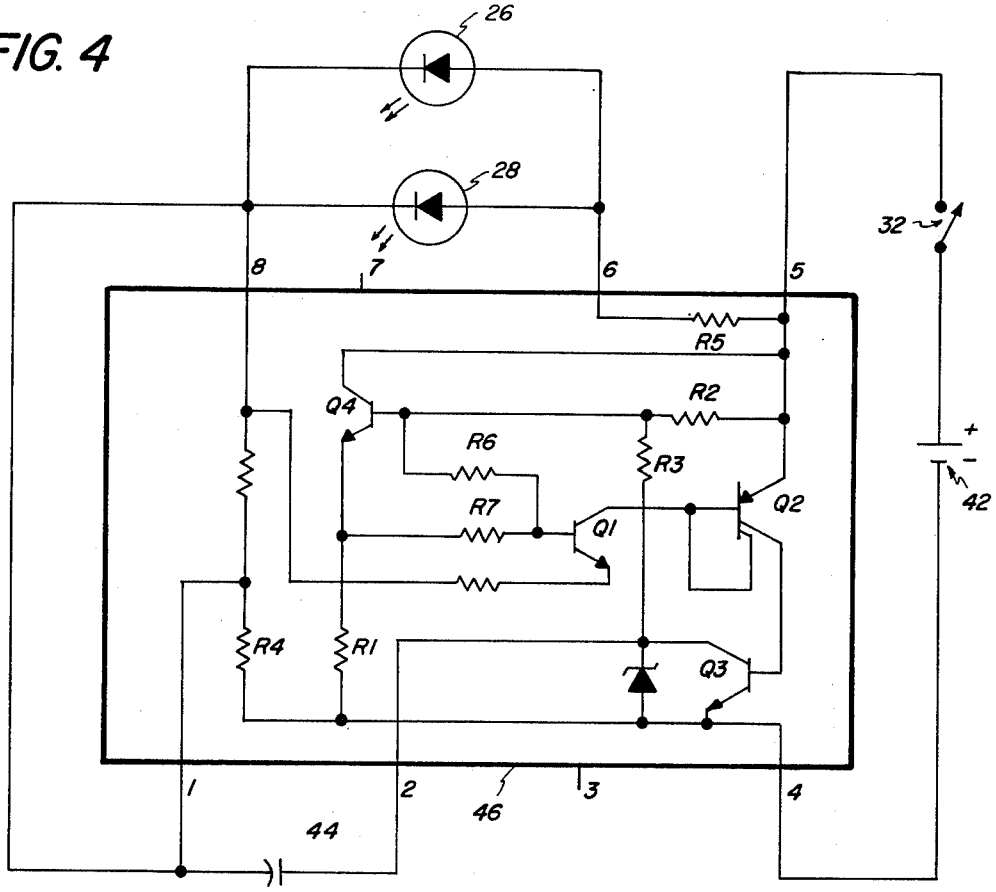

FIGS. 3 and 4 illustrate the circuitry which is enclosed within the housing 12. The individual circuit components are mounted on a circular printed circuit board 38 and comprise the two (2) LEDs 26 and 28, the switch 32, a battery holder 40 into which a circular battery 42 is inserted, a capacitor 44 and an integrated circuit chip 46. The integrated circuit chip 46 and the capacitor form an oscillator which when activated by battery 42 and switch 32 flashes the diodes 26 and 28 at a rate of about one hertz. A particularly advantageous integrated circuit chip which can be used to form the oscillator is the LM 3909 of the National Serviconductor Coporation, 2900 Serviconductor Drive, Santa Clara, Califormia 95051. A number of commercially available light-emitting diodes, capacitors, batteries, and microswitches can be used with the LM3909 integrated circuit. The following is therefore merely illustrative:

- Light Emitting Diodes—Red-Lit 209/RL-TI, Letronix, Inc. 1900 Homestead Road, Vollo Park, Cupertino, California 95014
- Capacitor—Sprague 30D Model TE 1064
- Battery—RM675, 1.4 volts, P. R. Mallory and Co., Inc., Box 1284 Indianapolis, Indiana 46206
- Microswitch—SMS-121M-1, SPDT without tabs with P/C terminals, Alco Electronics Products, Inc. 1551 Osgood Street, North Andover, Massachusetts 01845

Operating with a 1.5 volt battery, the circuit in FIG. 4 operates as follows. When the switch 32 is closed, all the transistors, but Q4 are off. The resistor $R_1$ from the transistor Q4's emitter to the supply common (pin 4) draws only about 50 microamperes. The capacitor 44 is charged through the resistors $R_2$ and $R_3$ connected to pin 5 and through the resistor $R_4$ connected to pin 4 of the circuit. Transistors Q1 through Q3 remain off until the capacitor 44 becomes charged to about 1 volt. This voltage is determined by the junction drop of transistor Q4, its base emitter voltage diodes comprising resistors $R_6$ and $R_7$ and the junction drop of transistor Q1. When the voltage at pin 1 becomes a volt more negative than at pin 5 (the battery supply positive terminal), Transistor Q1 begins to conduct. This then turns on transistors Q2 and Q3. The circuit then supplies a pulse of high current to the LEDs 26 and 28 turning them on. When transistor Q3 conducts, it rapidly pulls pin 2 close to the supply common (pin 4). Since the capacitor 44 is charged, its other terminal at pin 1 goes below the supply common. The voltage of the LEDs 26 and 28 is then higher than the battery voltage and the resistor $R_5$ between the pins 5 and 6 limits the current to the LEDs 26 and 28 which then turn off. The cycle then repeats as described above.

While specific components have been referred to for exemplary purposes, a wide array of components can be substituted for those mentioned. For example, by utilizing a different battery size, continuous operation can be effected for periods up to two and one half years which would obviate the need for switch 32.

The invention has been described with reference to a preferred embodiment thereof but it will be understood that variations and modifications can be effected within the spirit and scope of the invention.

I claim:

1. A novelty facial design button comprising:

(a) a printed circuit board having mounted thereon
  (1) a light emitting diode flasher circuit comprising a LM 3909 linear integrated circuit manufactured by National Semiconductor Corporation and a capacitor,
  (2) a 1.5 volt battery,
  (3) a switch, said battery and said switch being connected to the input terminals of said integrated circuit, and
  (4) at least first and second light-emitting diodes connected to the output terminals of said integrated circuit; and (b) a housing enclosing said printed circuit board, said housing having means defining at least first and second apertures, therein, and a facial design on at least one external surface, said printed circuit board being arranged within said housing so that said first and second diodes extend through said first and second apertures, respectively, and form at least a portion of said facial design.

2. A novelty button as defined in claim 1 further including fastening means mounted on said housing.

3. A novelty facial design button as defined in claim 1 wherein said housing includes means defining a third aperture therein and said switch extends through said third aperture.

* * * * *